United States Patent [19]

Hatley

[11] 4,041,565

[45] Aug. 16, 1977

[54] ROTATABLE BRUSHES

[75] Inventor: Kenneth John Hatley, Sanderstead, England

[73] Assignee: Butterworth Systems Inc., Bayonne, N.J.

[21] Appl. No.: 667,608

[22] Filed: Mar. 17, 1976

[30] Foreign Application Priority Data

Mar. 24, 1975 United Kingdom ..... 12153/75

[51] Int. Cl.[2] ..... A46B 7/08

[52] U.S. Cl. ..... 15/200; 15/1.7; 15/180

[58] Field of Search ..... 15/28, 29, 49 R, 50 R, 15/87, 180, 198, 1.7, 200; 114/222

[56] References Cited

U.S. PATENT DOCUMENTS

| | | | |
|---|---|---|---|
| 1,693,908 | 12/1928 | Marshall | 15/180 |
| 3,616,484 | 11/1971 | Charvat | 15/198 X |
| 3,906,572 | 9/1975 | Winn | 15/1.7 |

FOREIGN PATENT DOCUMENTS

| | | | |
|---|---|---|---|
| 455,803 | 4/1949 | Canada | 15/28 |
| 38,119 | 10/1927 | Denmark | 15/29 |
| 2,216,508 | 10/1973 | Germany | 15/29 |
| 2,333,707 | 1/1975 | Germany | 15/50 R |

*Primary Examiner*—Edward L. Roberts
*Attorney, Agent, or Firm*—F. D. Paris

[57] ABSTRACT

A rotatable brush suitable for removing growths and encrustations from submerged surfaces comprises a support, bristles attached to one face of the support adjacent to the periphery thereof and extending away from said one face, and a flexible or elastic membrane surrounding the bristles and which extends substantially from the support to substantially within 10 mm to 40 mm from the free ends of the bristles remote from said one face. The support may have one or more orifices each perforating both faces. The bristles may be formed of steel strips and the membrane may be made of rubberized canvas or nylon.

8 Claims, 3 Drawing Figures

ROTATABLE BRUSHES

The present invention relates to a rotatable brush which is particularly, but not exclusively, useful for removing growths and encrustations from submerged surfaces such as the normally submerged parts of ship's hulls.

In accordance with this invention a rotatable brush comprises a support, bristles attached to one face of the support adjacent to the periphery thereof and extending away from said one face, and a flexible or elastic membrane surrounding the bristles and which extends substantially from the support substantially to within 10 mm to 40 mm (e.g. 20 to 30 mm) from the free ends of the bristles remote from said one face.

In use, the brush is rotated, e.g. by means attached to the support, and when the brush is under water, the rotation causes water to be flung outwards from the volume which is laterally defined by the membrane, thereby reducing the pressure within said volume. The water tends to escape from the volume around the periphery of the membrane remote from the support.

When the brush is arranged for use in cleaning and underwater surface, the free ends of the bristles contact the underwater surface, and on rotation of the brush, the reduction in pressure in the volume defined by the support, the membranes and the surface promotes adhesion of the brush to the underwater surface. The free ends of the bristles are strongly urged into contact with the underwater surface thereby improving their ability to clean the surface.

The support is usually a substantially flat disc, but may if desired have slight curvature. It may have one or more orifices each perforating both faces so that water will be able to enter the volume laterally defined by the membrane and to wash away any debris which has been removed from the surface as it leaves the said volume, by passing between the underwater surface and the adjacent end of the membrane.

Preferably, the bristles are formed from stiff, but, flexible, hard material such as steel strips, strands of steel wire rope, suitable polymeric materials such as polypropylene or nylon filaments, or glass reinforced plastics.

In a preferred embodiment, the bristles diverge outwards away from the support so that when the bristles contact a surface, and the brush is rotated and translated over the surface, the free ends of the bristles are formed to a chisel edge. Such a chisel edge is capable of removing marine growths such as seaweed and barnacles from the submerged parts of ships hulls by a scything, cutting or chiselling action. Preferably, the bristles diverge outwards at an angle of from 30° to 60°, more preferably about 45°, relative to the plane of the said one surface of the support.

The provision of the membrane around the bristles increases the force which the bristles exert against an underwater surface, and also reduces energy losses in the water within the volume enclosed by the membrane, thereby reducing the power which is required to rotate the brush in contact with the underwater surface. This membrane is flexible or elastic and usually both flexible and elastic. The membrane may for example be made of rubberized canvas, nylon, polythene sheeting or rubber sheeting.

The brush of the invention may be employed in conjunction with apparatus of the type described and claimed in U.K. patent specification No. 1,092,133 and which comprises a chamber having an open side intended to face a submerged surface, and means (such as a propeller pump) for continuously maintaining a reduced pressure inside the chamber relative to the pressure outside the chamber so that the chamber adheres to the submerged surface. The apparatus may have neutral or negative buoyancy, and may be provided with wheels or rollers so that it can be relatively easily moved over, and/or steered on, the submerged surface. When such apparatus is provided with one or more brushes according to the invention, the power requirement to maintain the apparatus against the submerged surface is reduced. If the adhesion provided by the brush of the invention is adequately high, it may not be necessary to incorporate the brush with apparatus of the type described.

The invention is now illustrated with reference to the accompanying drawings wherein.

Figure 1:
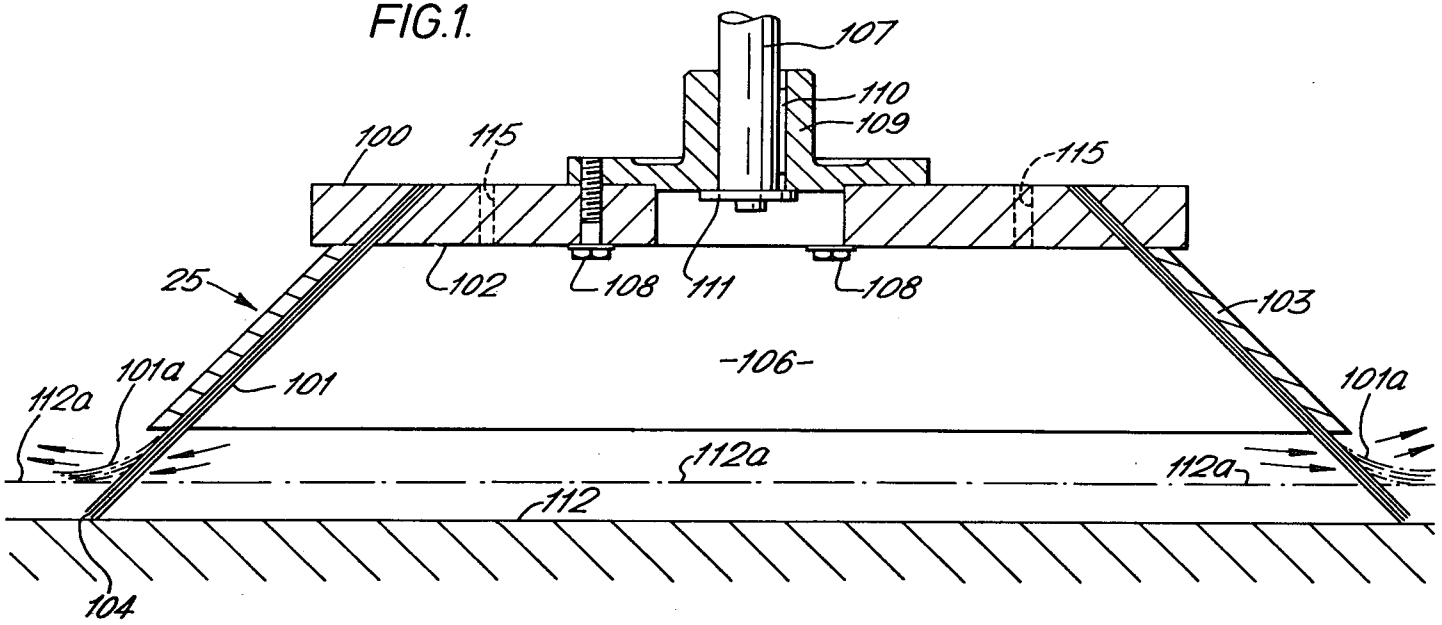
FIG. 1 is a cross-section through a brush in accordance with the invention.
Figure 3:
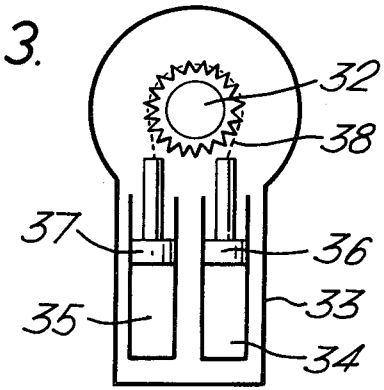
Figure 2:
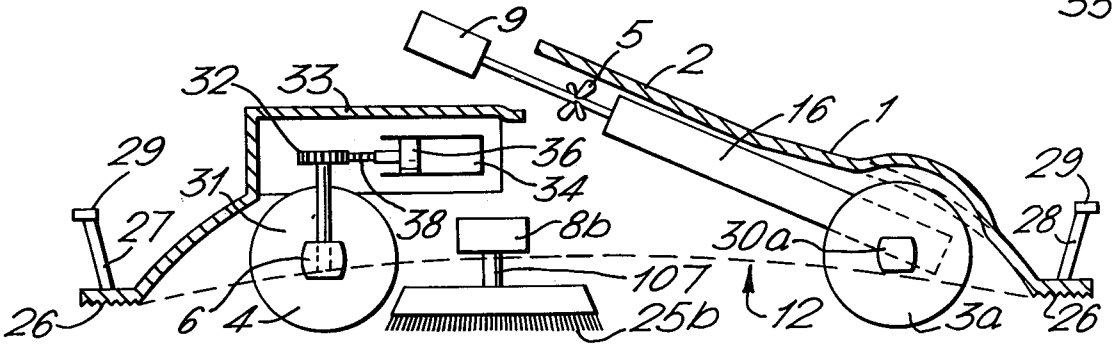
FIG. 2 is a cross-sectional view taken on line II—II of FIG. 3, of apparatus incorporating the brush of FIG. 1.

FIG. 3 is a diagram of a steering mechanism for the apparatus of FIG. 2, and In FIG. 1, the brush (generally indicated by reference 25) comprises a support in the form of a disc 100 and stiff springy bristles 101 of stainless steel strip which extend away from one face 102 of the disc 100 adjacent to the periphery thereof and diverge outwards at an angle of about 45° relative to the plane of the face 102. A flexible membrane 103 of rubberized canvas or nylon is attached to the disc 100 immediately outwards of the bristles 101 and extends away from the face 102 towards the free ends 104 of the bristles (about 25 mm from the free ends) so as to define laterally a volume 106 bounded at one end by the face 102.

The disc 100 is attached to a rotatable shaft 107 by bolts 108 which engage a flanged part of a collar 109 having a key-and-keyway arrangement 110 with the shaft 107. Axial movement of the shaft away from the volume 106 is prevented by a washer 111 engaging the collar 109.

When the brush 25 is rotated, by rotating the shaft 107, and placed or urged against an underwater surface 112, water is flung to the outer regions of volume 106 and tends to pass between the surface 112 and the adjacent end of the membrane 103, as indicated by the arrows. As a result, the pressure in volume 106 is reduced and because the pressure outside volume 106 is substantially unchanged, the brush 25 will be urged towards the surface 112. In practice, some additional force to urge the brush towards surface 112 will usually be provided, so that the bristles 101 tend to splay outwards at their ends to some extent, as shown by the broken lines 101a (the broken line 112a representing the surface 112 under these circumstances). When the brush 25 is moved over the surface, the combination of the rotational and translation motion forms the ends of the bristles 101 to a chisel edge capable of removing marine growths from the surface 112.

It is found that the power required to rotate the brush 25 under water is reduced by the provision of the membrane 103, compared to the power requirement in the absence of the membrane 103. It is believed that this is because the membrane 103 substantially prevents or reduces the entry of water into the volume 106 from outside the volume 106 thereby reducing turbulence in the water in volume 106.

It will be seen that the disc 102 has holes 115 therethrough. These permit the ingress of water during use of the brush 25 so that there will be a flow of water "through" the brush for carrying away debris with water which leaves volume 106 between the surface 112 and the adjacent edge of the membrane 103.

Referring to FIGS. 2 and 3 of the drawing, the chamber 1 has an open side 12, and an impeller duct 2. Around the peripheral edge of the chamber are a series of corrugations 26 which limit the ingress of water into the chamber. The chamber 1 houses a driving motor 16, which drives the impeller 5 and the hydraulic pump 9. This hydraulic pump pumps hydraulic fluid through pipes, to drive motors for the wheels and brushes. In order to facilitate handling, there is a handrail 29 attached to the top side of the chamber by rail supports, two of which are shown at 27 and 28.

The steerable wheel 4 is held in a yoke 31 which is fixed to a sprocket drive wheel 32. Housed inside the casing 33 are two hydraulically operated steering rams 34 and 35 having pistons 36 and 37 respectively. A chain 38 connected to the pistons 36 and 37 drives the wheel 32.

What is claimed is:

1. A brush adapted for cleaning a surface and having an axis of rotation substantially perpendicular to the surface, comprising a support substantially perpendicular to said axis, bristles attached to one face of the support adjacent to and disposed about the periphery thereof and extending at a diverging angle away from said one face, and a flexible membrane surrounding the bristles and which extends substantially from the support to substantially within 10 mm to 40 mm from the free ends of the bristles remote from said one face, said membrane defining a laterally confined volume with said one face of said support and diverging in substantially the same direction as said bristles and preventing liquid from entering said confined volume, such that the pressure within said confined volume is substantially reduced for producing a corresponding reduction in the power required to rotate said brush.

2. A rotatable brush according to claim 1 wherein the support is a substantially flat disc.

3. A brush according to claim 1 wherein the support has at least one orifice perforating both faces of said support radially disposed of said axis.

4. A rotatable brush according to claim 3 wherein the bristles are formed of steel strips.

5. A rotatable brush according to claim 1 wherein the bristles diverge outwards at an angle of from 30° to 60° relative to the plane of said one surface of the support.

6. A brush according to claim 3 wherein the membrane comprises an elastic material.

7. A brush according to claim 6 wherein said membrane comprises rubberized canvas.

8. A brush according to claim 6 wherein said membrane comprises nylon.

* * * * *